US006558065B2

(12) United States Patent
Huang

(10) Patent No.: US 6,558,065 B2
(45) Date of Patent: May 6, 2003

(54) GEOMETRIC CONSTRUCTION SYSTEM

(76) Inventor: Te-Li Huang, No. 17, Alley 2, Lane 260, Han-Hsi W. Rd., Tung Dist., Taichung City (TW)

( * ) Notice: Subject to any disclaimer, the term of this patent is extended or adjusted under 35 U.S.C. 154(b) by 0 days.

(21) Appl. No.: 09/901,417

(22) Filed: Jul. 9, 2001

(65) Prior Publication Data

US 2003/0007829 A1 Jan. 9, 2003

(51) Int. Cl.[7] ..... A63H 33/10

(52) U.S. Cl. ..... 403/170; 403/176; 403/180; 52/646

(58) Field of Search ..... 403/169–170, 403/176, 180, 279, 282, 326; 446/111–113, 107, 108, 124, 126, 128; 52/646, 81.4, DIG. 10

(56) References Cited

U.S. PATENT DOCUMENTS 4,603,519 A * 8/1986 Lew et al. ..... 403/170
4,758,196 A * 7/1988 Wang ..... 403/171
4,765,495 A * 8/1988 Bisk ..... 211/113
5,046,982 A * 9/1991 Erickson ..... 446/112
5,372,450 A * 12/1994 Blodgett ..... 403/171
5,472,365 A * 12/1995 Engel ..... 403/170
5,544,438 A * 8/1996 Fazekas ..... 16/366
5,545,070 A * 8/1996 Liu ..... 446/102
5,575,701 A * 11/1996 Hantman ..... 446/104
5,833,511 A * 11/1998 Outman ..... 446/104
D409,668 S * 5/1999 Madner ..... D21/484
6,176,757 B1 * 1/2001 Lin ..... 446/102

* cited by examiner

*Primary Examiner*—James R. Brittain
(74) *Attorney, Agent, or Firm*—Ladas & Parry

(57) ABSTRACT

A geometric construction system includes at least a coupling lever and at least two substantially flat frames of equilateral polygonal shape, each of which defines a frame space therein and each of which includes equilateral side portions that confine the frame space, and pivotal parts that are disposed within the frame space and that are connected to the side portions. The coupling lever has two opposite pivotal ends respectively pivoted to a selected one of the pivotal parts of one of the frames and a selected one of the pivotal parts of the other one of the frames so as to permit the frames to be turnable relative to the coupling lever.

1 Claim, 12 Drawing Sheets

GEOMETRIC CONSTRUCTION SYSTEM

BACKGROUND OF THE INVENTION

1. Field of the Invention

This invention relates to a geometric construction system, more particularly to a geometric construction system including a plurality of flat frames of polygonal shape and a plurality of coupling levers for coupling the frames.

2. Description of the Related Art

Conventional geometric construction systems normally include a plurality of panels of polygonal shape, which can be coupled together to form two- and three-dimensional arrays. However, the thus-formed arrays are normally fixed in shape and cannot be instantly transformed from one shape to another without re-assembly of the panels.

SUMMARY OF THE INVENTION

Therefore, it is an object of the present invention to provide a geometric construction system that is capable of overcoming the aforementioned drawbacks.

Accordingly, a geometric construction system of this invention comprises: at least two substantially flat frames of equilateral polygonal shape, each of which defines a frame space therein and each of which includes equilateral side portions that confine the frame space, and equilaterally spaced apart pivotal parts that are disposed within the frame space and that are connected to the side portions; and at least a coupling lever that has two opposite pivotal ends respectively pivoted to a selected one of the pivotal parts of one of the frames and a selected one of the pivotal parts of the other one of the frames so as to permit the frames to be turnable relative to the coupling lever.

BRIEF DESCRIPTION OF THE DRAWINGS

In drawings which illustrate an embodiment of the invention.

DETAILED DESCRIPTION OF THE PREFERRED EMBODIMENTS

Figure 1:
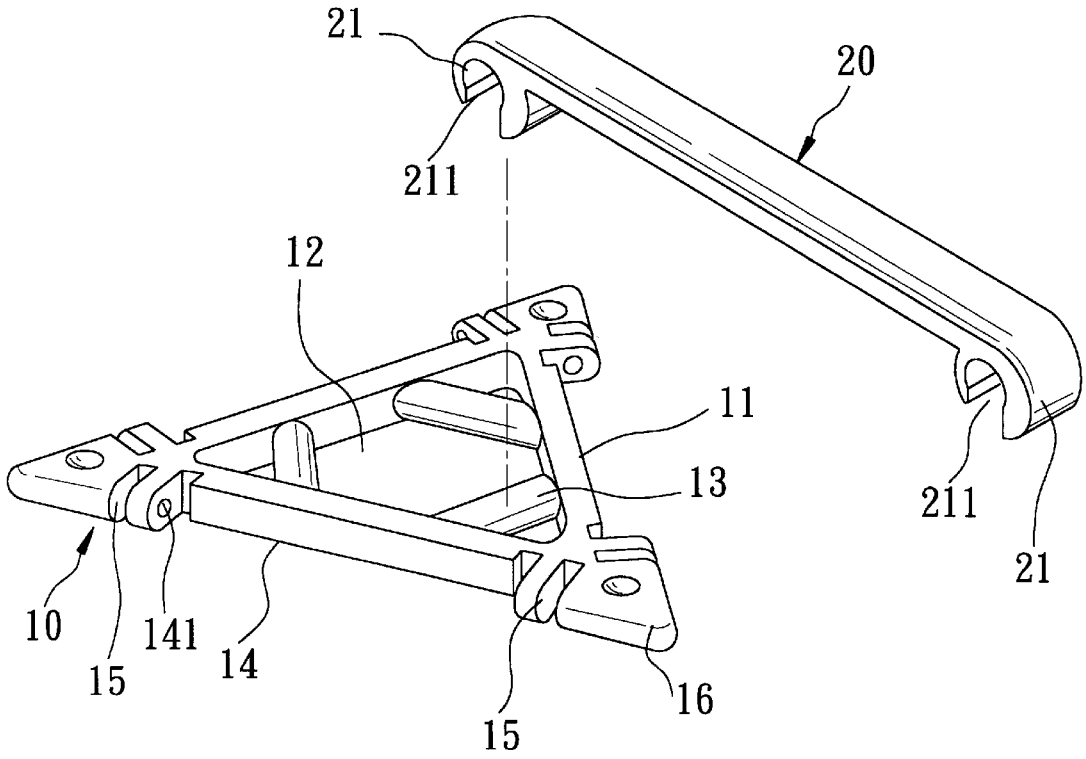
FIG. 1 is a perspective view of a preferred embodiment of a geometric construction system embodying this invention, which includes a flat frame and a coupling lever.
Figure 2:
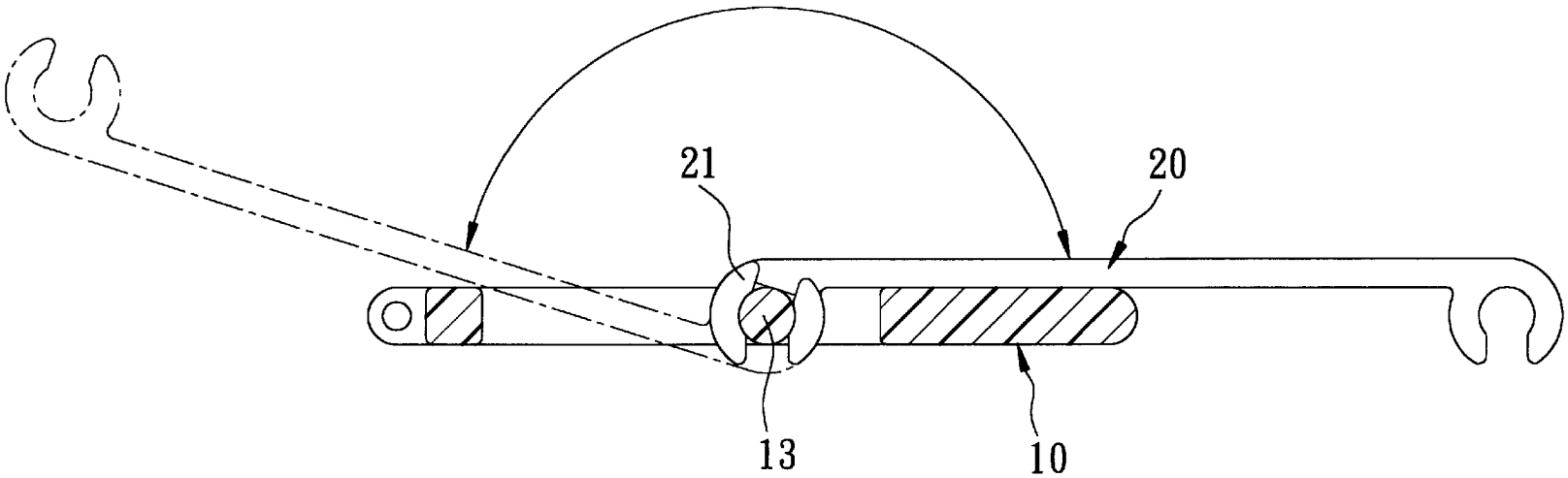
FIG. 2 is a cross-sectional side view to illustrate how the flat frame engages the coupling lever of FIG. 1.

FIGS. 1 to 5 illustrate a preferred embodiment of a geometric construction system of this invention. The geometric construction system includes: a plurality of substantially flat frames 10 of equilateral polygonal shape, each of which defines a frame space 12 therein and each of which includes equilateral side portions 11 that confine the frame space 12, and equilaterally spaced apart pivotal parts 13 that are disposed within the frame space 12 and that are connected to the side portions 11; and a plurality of coupling levers 20, each having two opposite pivotal ends 21 respectively pivoted to a selected one of the pivotal parts 13 of one of the frames 10 and a selected one of the pivotal parts 13 of another one of the frames 10 so as to permit the frames 10 to be turnable relative to the coupling lever 20. The frames 10 are triangular in shape in this preferred embodiment. However, the frames 10 can also be in the form of other shapes, such as square or hexagonal, etc.

The pivotal parts 13 of each frame 10 are preferably in the form of a rod that interconnects two adjacent ones of the side portions 11 of the frame 10. Each of the pivotal ends 21 of each coupling lever 20 has a C-shaped protrusion that is sleeved fittingly and rotatably on a respective one of the pivotal parts 13.

Figure 3:
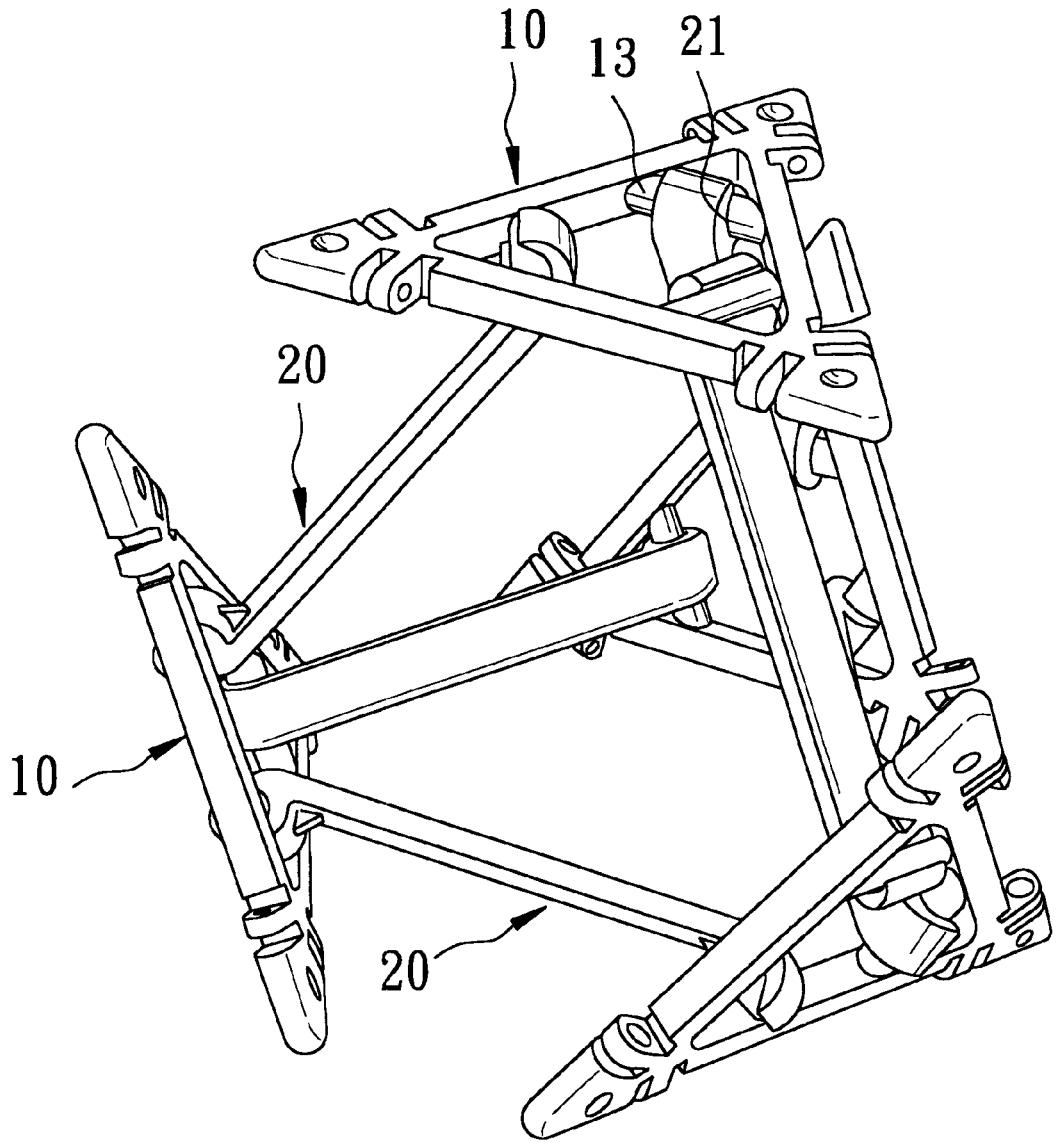
FIGS. 3 to 5 are perspective views to illustrate how the geometric construction system of FIG. 1 can be constructed into different configurations of three-dimensional arrays.
Figure 4:
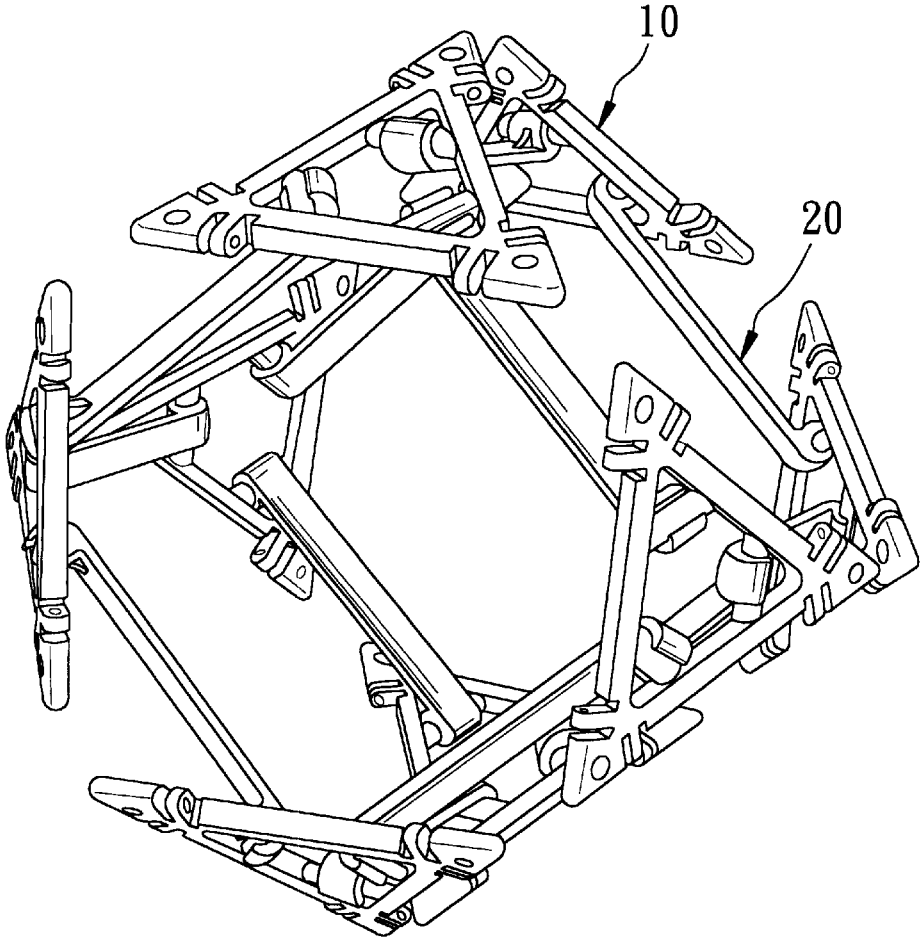
Figure 5:
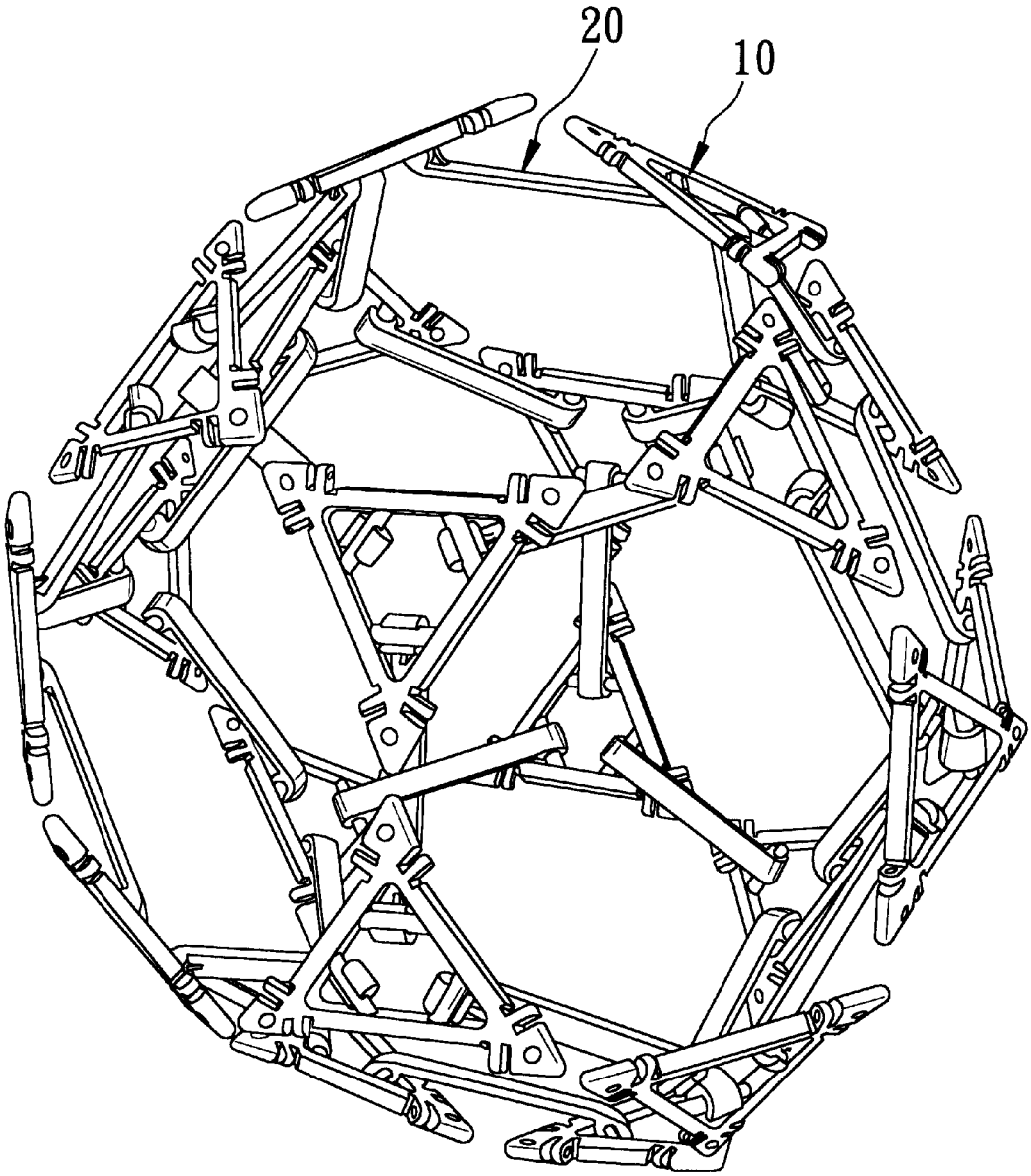

FIGS. 3 to 5 illustrate how the geometric construction system of FIG. 1 can be constructed into different configurations of three-dimensional arrays.

Figure 6:
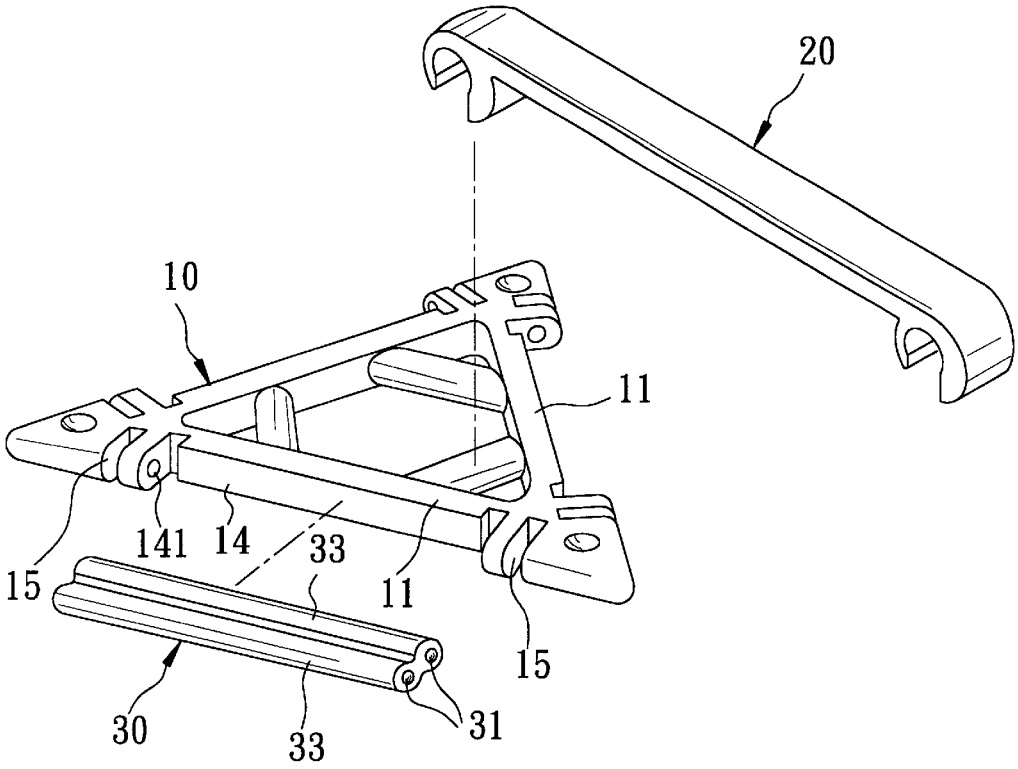
FIG. 6 is a perspective view to illustrate that the geometric construction system of FIG. 1 can further include a connecting rod.

Referring to FIGS. 6 to 10, by incorporating a plurality of connecting rods 30, the geometric construction system of FIG. 1 can be further constructed into various configurations of complex three-dimensional arrays. As best shown in FIG. 6, each side portion 11 of each frame 10 is formed with a recess 14 defined by a recess face that has two opposite end faces formed with protrusions 141. Each connecting rod 30 has a generally elliptical cross-section, and two interconnected connecting portions 33, each of which is complementary to and is received in the recess 14 in a selected one of the side portions 11 of a respective frame 10 and each of which has two opposite ends provided with grooves 31 that respectively receive the protrusions 141 on the respective side portion 11 of the respective frame 10 so as to permit the frames 10 to be freely turnable relative to the respective connecting rods 30. A pair of slits 15 are formed in each side portion 11 of each frame 10 and are disposed respectively adjacent to the end faces of the recess face of a respective recess 14 so as to facilitate insertion of the connecting rod 30 into the respective recess 14.

Figure 7:
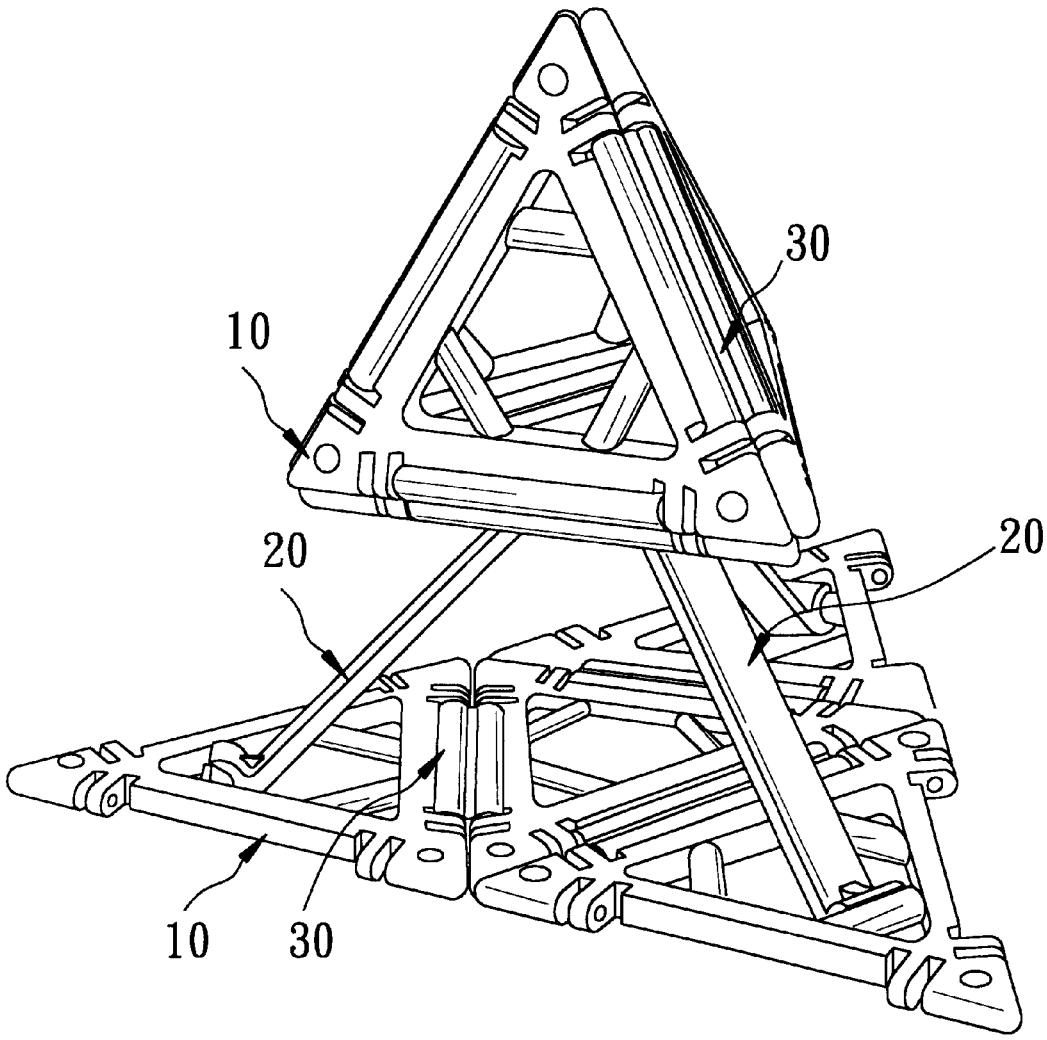
FIGS. 7 and 8 are perspective views to illustrate how a three-dimensional array of the geometric construction system of FIG. 1 can be instantly transformed from one shape to another.
Figure 8:
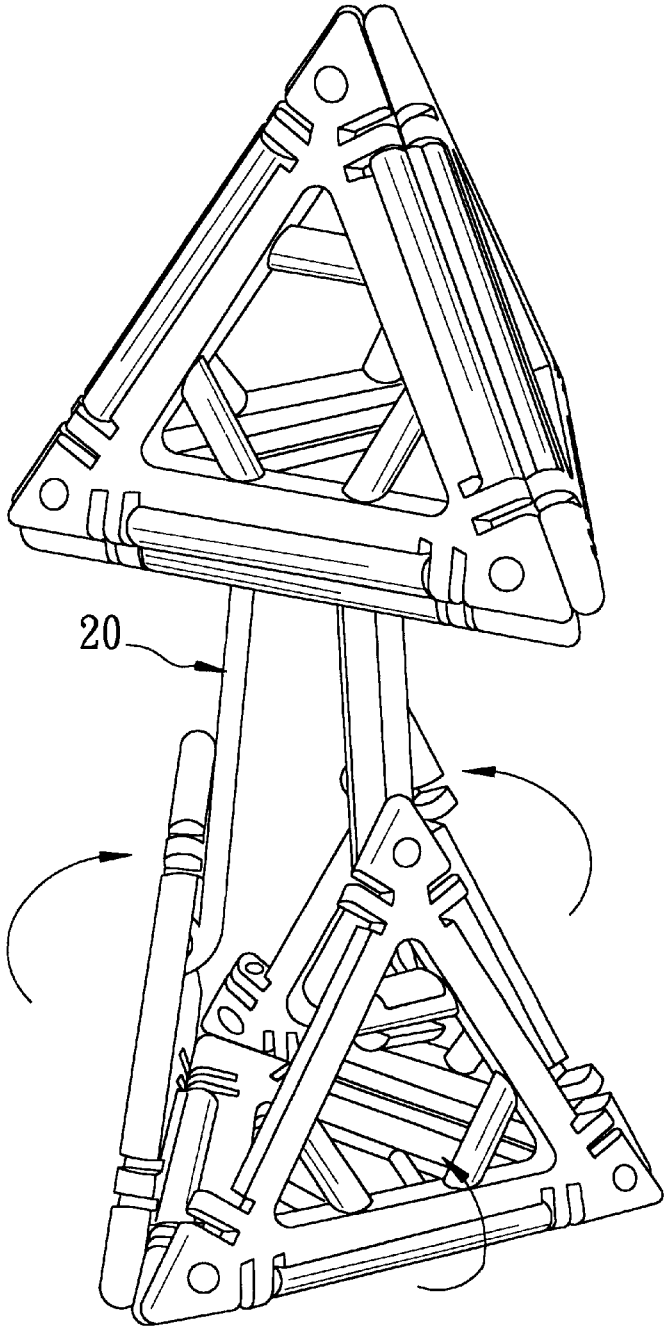
Figure 9:
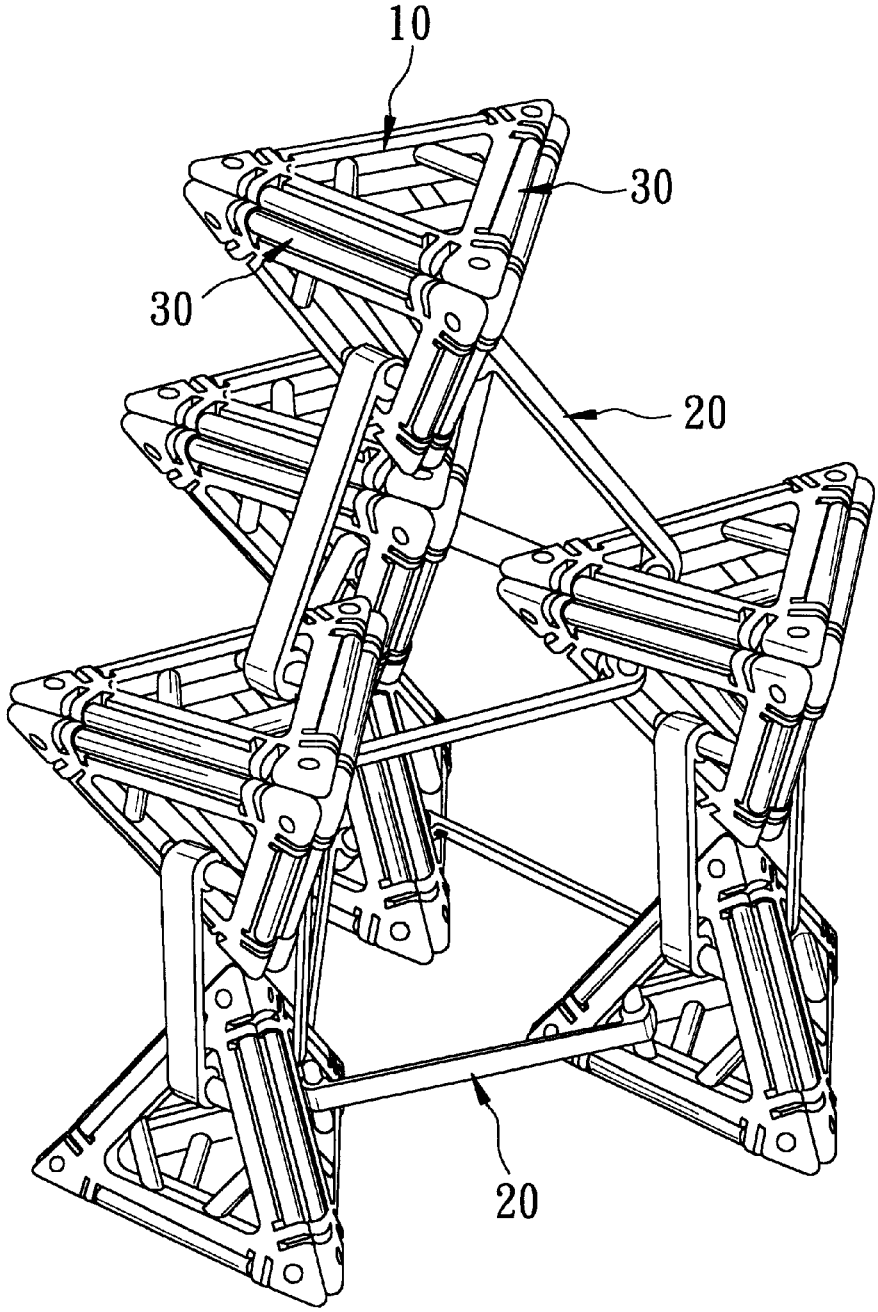
FIGS. 9 and 10 are perspective views to illustrate how the geometric construction system of this invention can be further constructed into different complex configurations.
Figure 10:
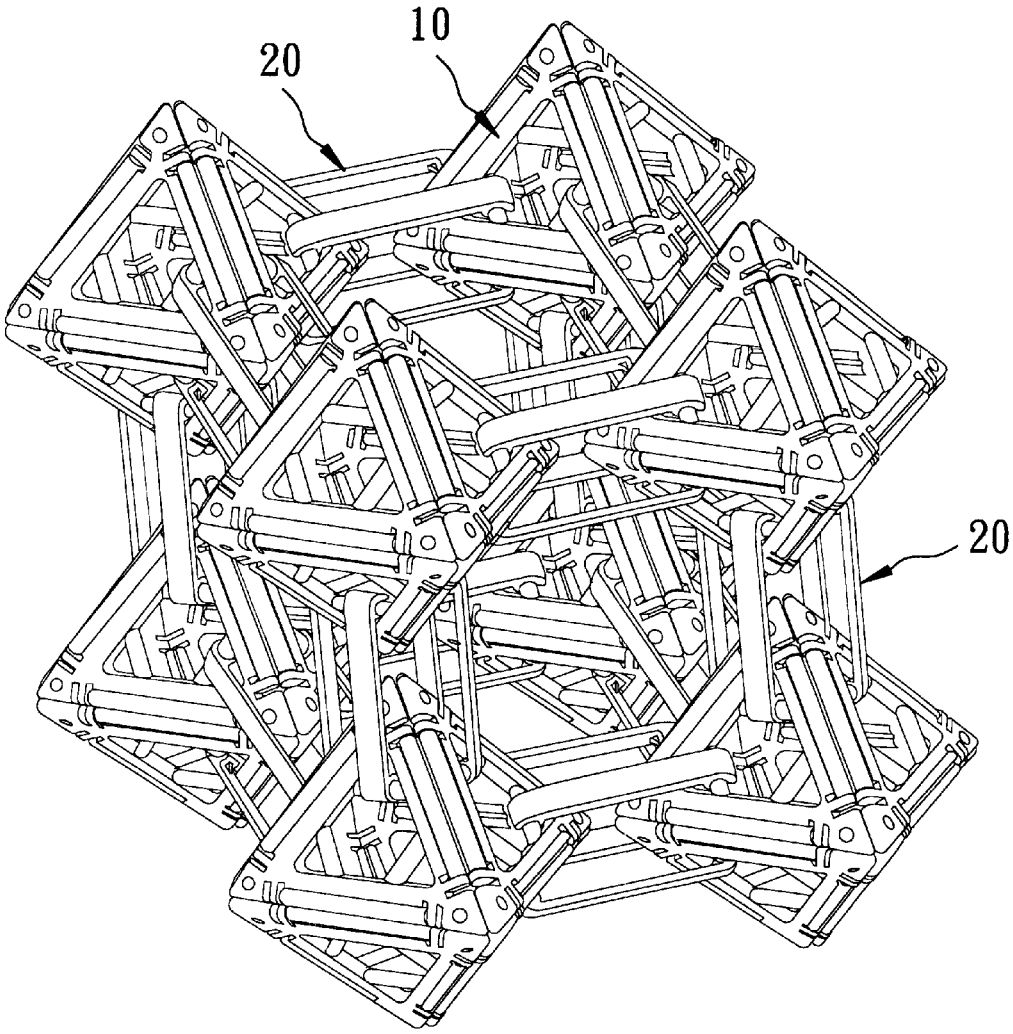

As an example, FIGS. 7 and 8 simply demonstrate that the three-dimensional arrays of the geometric construction system of FIG. 1 can be instantly transformed from one shape to another without re-assembly of the frames 10 and the coupling levers 20.

Figure 11:
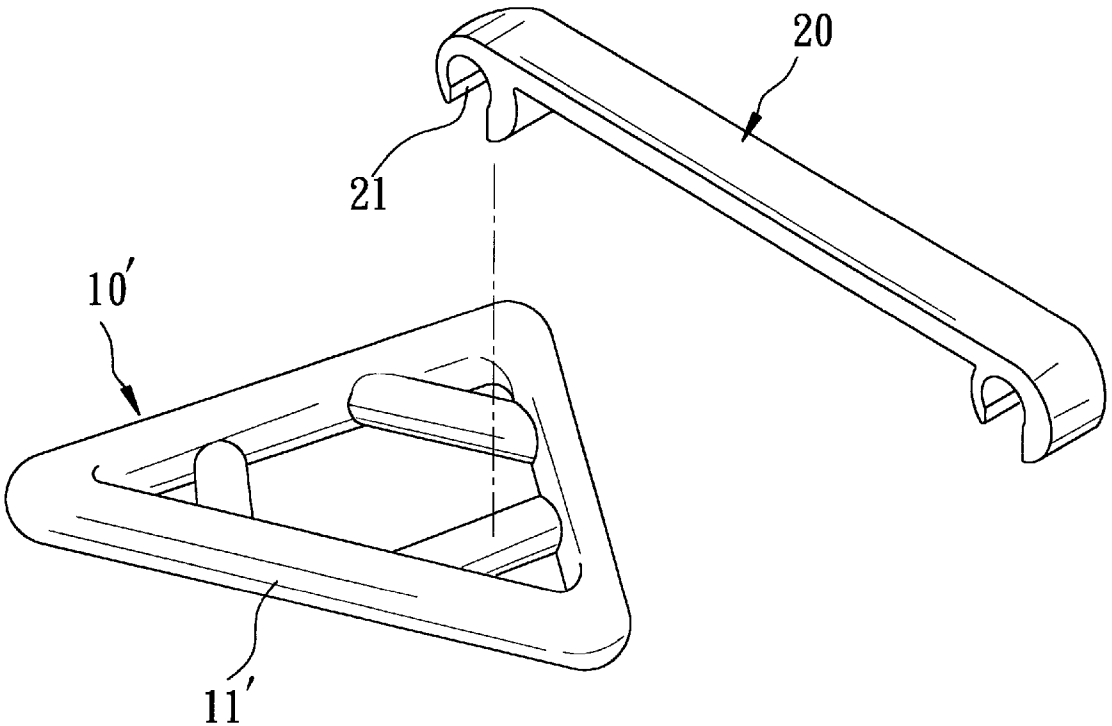
FIG. 11 is a perspective view of a second preferred embodiment of a geometric construction system of this invention, with a triangular flat frame modified from that shown in FIG. 1.
Figure 12:
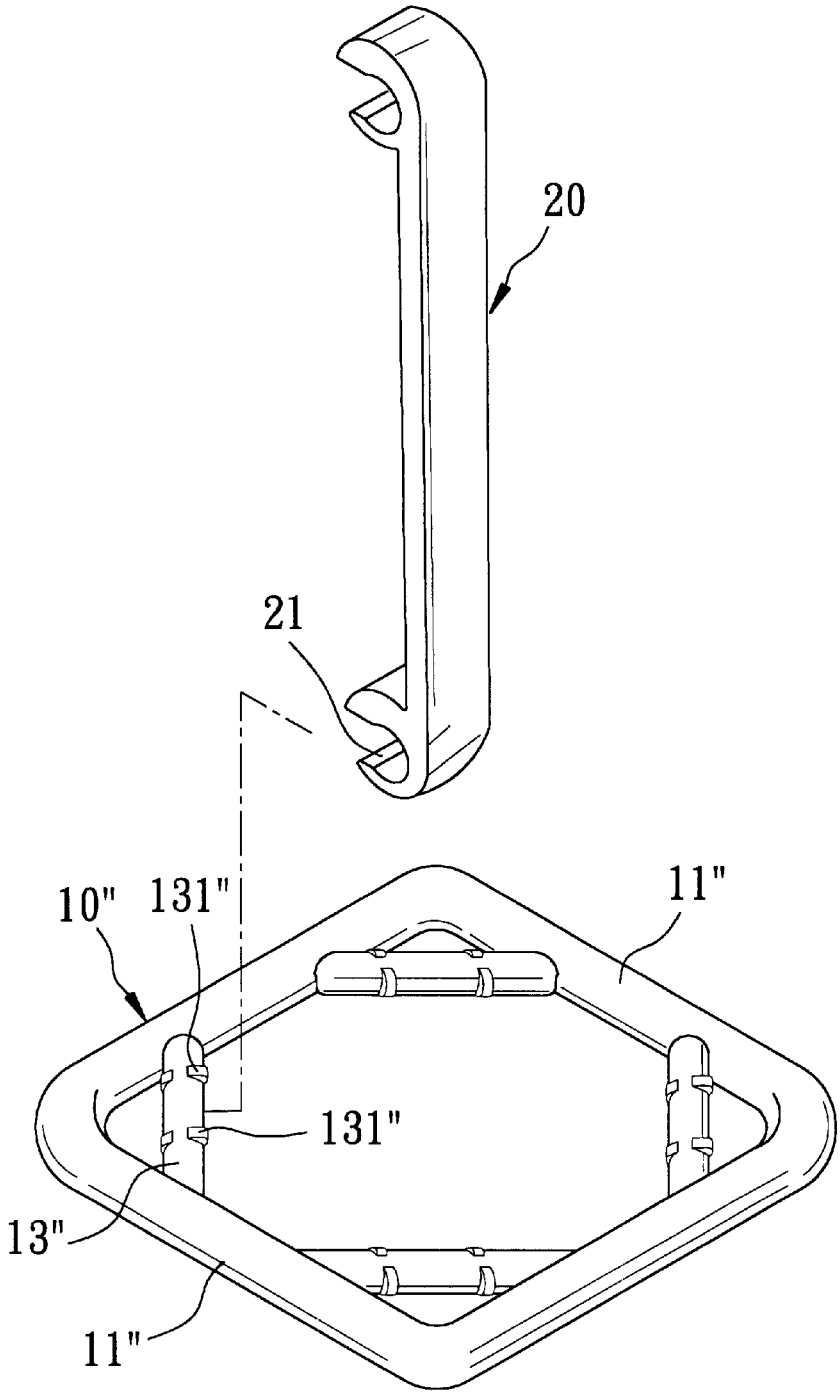
FIG. 12 is a perspective view of a third preferred embodiment of a geometric construction system of this invention, with the flat frame being square in shape.

FIGS. 11 and 12 respectively illustrate second and third preferred embodiments of the geometric construction system modified from that shown in FIG. 1. In FIG. 11, the side portions 11' of each frame 10' are not formed with the recesses 14. In FIG. 12, each frame 10" is square in shape, and the side portions 11" of each frame 10" are not formed with the recesses 14. Moreover, the pivotal parts 13" are provided with stoppers 131" for preventing axial movement of the coupling lever 20 along the length of the respective pivotal part 13".

With the pivotal parts 13 (13"), the coupling levers 20 and the connecting rods 30, the geometric construction system of this invention can be constructed into various configurations of three-dimensional arrays, and can be instantly transformed from one shape to another without the need to re-assemble the frames 10 and the coupling levers 20.

With the invention thus explained, it is apparent that various modifications and variations can be made without departing from the spirit of the present invention. It is therefore intended that the invention be limited only as recited in the appended claims.

I claim:

1. A geometric construction system comprising:

a plurality of substantially flat frames of equilateral polygonal shape, each of which defines a frame space therein and each of which includes equilateral side portions that confine said frame space, and equilaterally spaced apart pivotal parts that are disposed within said frame space and that are connected to said side portions, each of said side portions of each of said frames being formed with a recess that is defined by a recess face which has two opposite end faces that are formed with protrusions;

a plurality of coupling levers, each of which is associated with two adjacent ones of said frames and each of which has two opposite pivotal ends respectively pivoted to a selected one of said pivotal parts of one of said two adjacent ones of said frames and a selected one of said pivotal parts of the other one of said two adjacent ones of said frames so as to permit said frames to be turnable relative to said coupling lever; and a plurality of connecting rods, each having two interconnected connecting portions, each of which is complementary to and is received in said recess in a selected one of said side portions of a respective one of said frames and each of which has two opposite ends formed with grooves that respectively receive said protrusions on the selected one of said side portions of the respective one of said frames.

* * * * *